US006578609B1

(12) United States Patent
McNicol et al.

(10) Patent No.: US 6,578,609 B1
(45) Date of Patent: Jun. 17, 2003

(54) APPARATUS FOR DEBARKING LOGS WITH MOVABLE DEBARKING SURFACE FOR VARYING RATE OF DEBARKING

(75) Inventors: Robert Michael McNicol, Mission (CA); Michael Poropat, Surrey (CA)

(73) Assignee: Cae Wood Products G.P., Vancouver (CA)

( * ) Notice: Subject to any disclaimer, the term of this patent is extended or adjusted under 35 U.S.C. 154(b) by 0 days.

(21) Appl. No.: 10/194,599

(22) Filed: Jul. 12, 2002

(51) Int. Cl.[7] ..... B27L 1/00

(52) U.S. Cl. ..... 144/208.9; 144/208.1; 144/341; 241/299

(58) Field of Search ..... 241/299, 178, 241/278.2; 144/208.1, 208.9, 241, 340, 341

(56) References Cited

U.S. PATENT DOCUMENTS 3,190,327 A 6/1965 Robbins
3,862,653 A 1/1975 Fay et al.
3,863,692 A 2/1975 Hasada
4,691,750 A 9/1987 Nakajima
4,771,953 A 9/1988 Morey
5,070,919 A 12/1991 Ackerman
5,117,881 A 6/1992 Simpson
5,896,901 A 4/1999 Lacroix

*Primary Examiner*—W. Donald Bray
(74) *Attorney, Agent, or Firm*—Fulwider Patton Lee Utecht & Lee, LLP

(57) ABSTRACT

An apparatus for debarking logs comprising a drum rotatable about an axis and having an inner surface and outer surface with at least one movable debarking surface adjacent the inner surface of the drum to debark logs that come into contact with the movable debarking surface at a first rate. There is at least one fixed debarking surface at the inner surface of the drum to debark logs that come into contact with the fixed debarking surface at a second rate. The movable debarking surface is movable with respect to the inner surface of the drum between an operating position to allow contact between the movable debarking surface and the logs and a retracted position to minimize contact between the movable debarking surface and the logs.

32 Claims, 2 Drawing Sheets

APPARATUS FOR DEBARKING LOGS WITH MOVABLE DEBARKING SURFACE FOR VARYING RATE OF DEBARKING

FIELD OF THE INVENTION

This invention relates to apparatus for removing bark from raw logs, and, more particularly, to a drum type debarker with variable debarking action.

BACKGROUND OF THE INVENTION

Debarking equipment for removing bark from logs prior to additional processing by other wood processing equipment is well known. Examples of prior art debarking equipment known to the inventors includes the following patents:

U.S. Pat. No. 3,190,327 to Robbins

U.S. Pat. No. 3,862,653 to Fay et al.

U.S. Pat. No. 3,863,692 to Hasada et al.

U.S. Pat. No. 4,691,750 to Nakajima

U.S. Pat. No. 4,771,953 to Morey

U.S. Pat. No. 5,070,919 to Ackerman; and

U.S. Pat. No. 5,117,881 to Simpson

Many existing designs for debarking equipment rely on a drum arrangement into which logs to be debarked are fed. The drum is mounted for rotation about a generally horizontal, longitudinal axis and the inner surface of the drum has a sequence of longitudinal flights or ridges that run parallel to the axis of rotation. As the drum is rotated, the flights act to carry the logs to an elevated position where they are dropped due to gravity to make contact with other logs and lower flights which act to remove bark from the logs by abrasion.

The rate at which logs are debarked in a drum-type debarker depends on various factors including log condition, log diameter, temperature, and log species which all affect the adherence of the bark to the underlying wood.

Conventional drum-type debarking equipment suffers from the disadvantage that it is limited in its ability to control and vary the rate of debarking. When conditions are such that bark is easily removed from a batch of logs, the residence time of the logs in the drum until the bark is removed is reduced. If a batch of logs has bark that is more difficult to remove, the residence time has to be increased. In some equipment, the drum can be rotated at different speeds. A slower rotation speed accommodates logs with easily removed bark while a faster speed tends to debark more difficult logs with approximately the same residence time.

SUMMARY OF THE INVENTION

The present invention provides debarking apparatus that allows for variation in the rate of debarking by moving an abrasive debarking surface into an operating position to contact logs and increase the rate of debarking and a retracted position to minimize contact with logs and decrease the rate of debarking.

Accordingly, the present invention provides apparatus for debarking logs comprising:

a drum rotatable about an axis and having an inner surface and outer surface;

at least one movable debarking surface adjacent the inner surface of the drum to debark logs that come into contact with the movable debarking surface at a first rate;

at least one fixed debarking surface at the inner surface of the drum to debark logs that come into contact with the fixed debarking surface at a second rate;

the at least one movable debarking surface being movable with respect to the inner surface of the drum between an operating position to allow contact between the movable debarking surface and the logs and a retracted position to minimize contact between the movable debarking surface and the logs.

The present invention also provides apparatus for debarking logs comprising:

a drum rotatable about an axis and having an inner surface and outer surface;

at least one movable debarking surface adjacent the inner surface of the drum to debark logs that come into contact with the movable debarking surface at a first rate;

the at least one movable debarking surface being movable with respect to the inner surface of the drum between an operating position to allow contact between the movable debarking surface and the logs and a retracted position to minimize contact between the movable debarking surface and the logs.

Preferably, the at least one movable debarking surface comprises a movable plate that is automatically moved to the operating position whenever the plate rotates with the drum to the drum's lower periphery where the majority of debarking occurs as lifted logs fall by gravity to the bottom of the drum.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
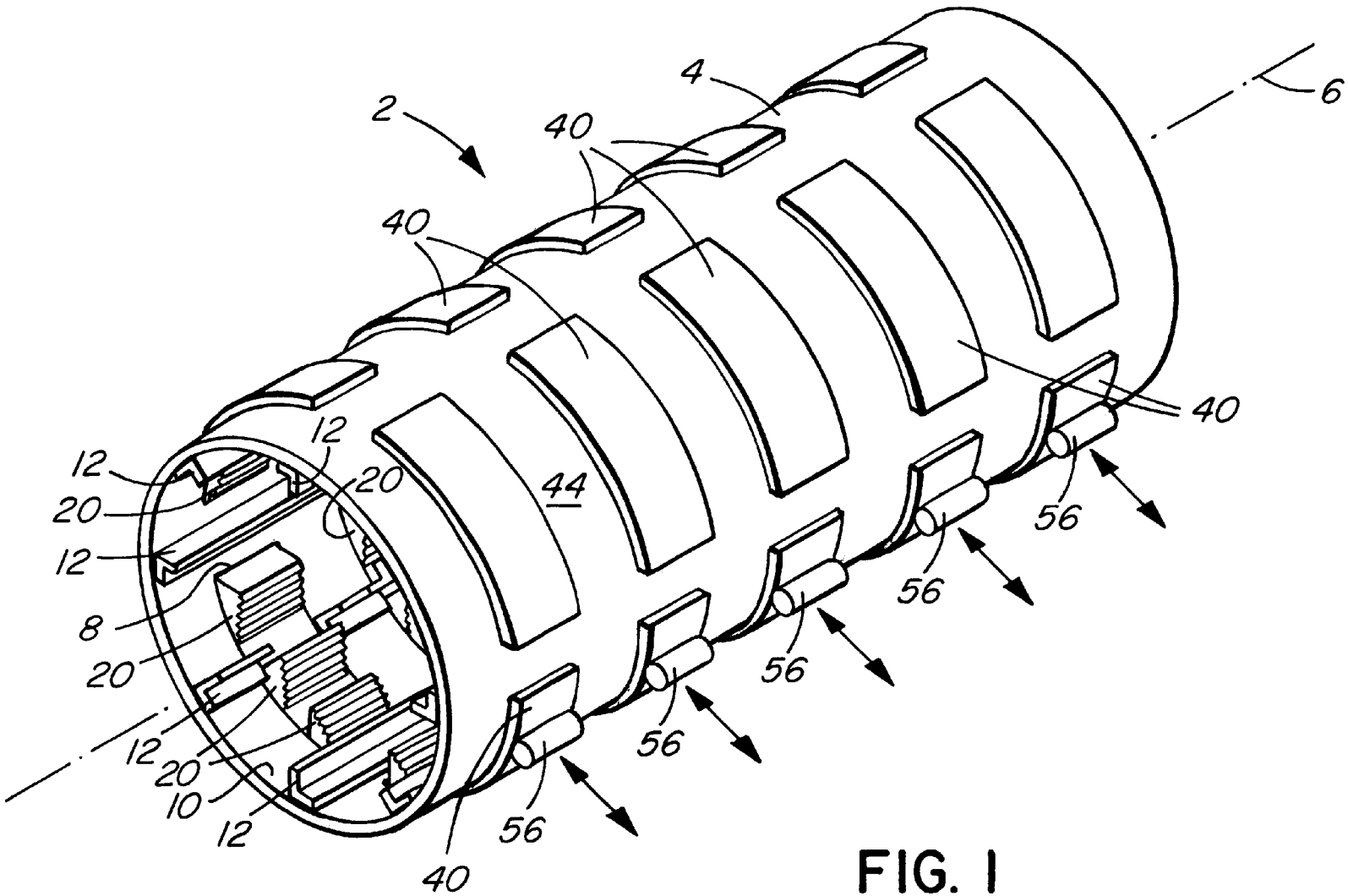
FIG. 1 is a schematic view of the debarking equipment of the present invention according to a preferred embodiment.

Referring to FIG. 1, there is shown a drum-type debarker 2 according to the present invention. Drum 4 is mounted for rotation about an axis 6 and is formed with a hollow interior 8. Logs requiring debarking are introduced into interior 8 and exit from the drum at the end of the process. The inner surface 10 of drum 4 preferably includes a plurality of fixed projections or flights 12 extending generally parallel to the axis of rotation 6 and extending radially inwardly into interior 8 of the drum to terminate at a top edge 14. In the illustrated embodiments, flights 12 are shown with a generally L-shaped cross-section. It will be apparent to those skilled in the art that alternative flights are possible. Flights having a substantially triangular or dome shaped cross-section are known in conventional debarking equipment and will function adequately with the equipment of the present invention.

Flights 12 are spaced about inner surface 10 and act to lift and drop logs introduced into drum interior 8 as the drum is rotated about axis 6. The debarking equipment of the present invention also includes additional debarking apparatus 20 adjacent inner surface 10 comprising at least one movable debarking surface 22 to debark logs that come into contact with the movable debarking surface at an increased rate. The movable debarking surface 22 is movable with respect to the inner surface of the drum between an operating position to allow contact between the movable debarking surface and the logs and a retracted position to minimize contact between the movable debarking surface and the logs.

Figure 2:
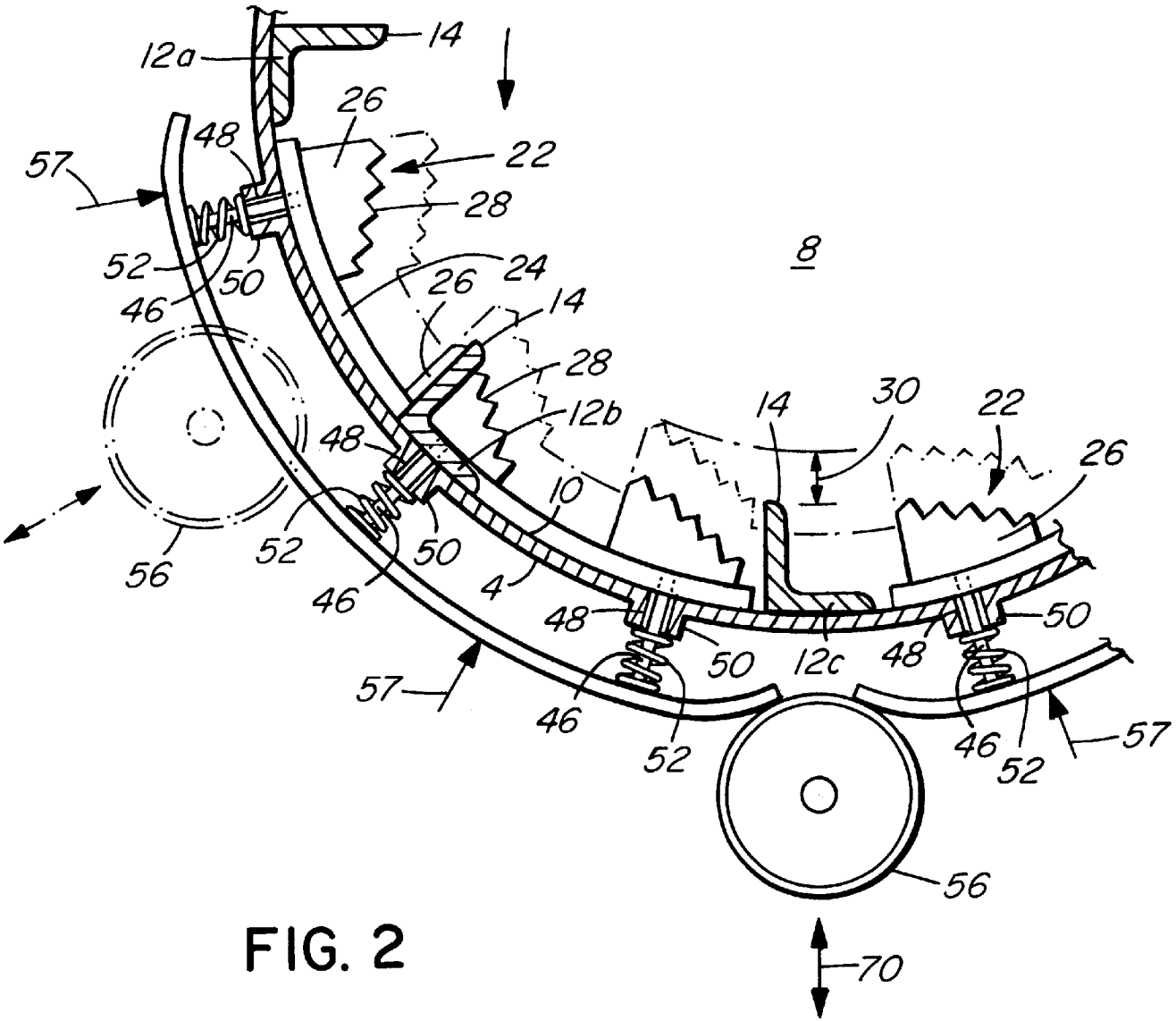
FIG. 2 is a detail section view showing the components and operation of the debarking surfaces of the invention.

FIG. 2 is a detail section view through drum 4 showing the details of a preferred embodiment of the present invention. In the illustrated embodiment, the additional debarking apparatus 20 comprises at least one movable debarking surface 22 that is positionable below the extent of the top edge 14 of the fixed flights 12 when in the retracted position. Preferably, flights 12 are not continuous and are interrupted by gaps at spaced intervals along the length of the drum to define a plurality of recessed regions. The regions on sets of adjacent flights 12 are aligned to create a circumferential cavity across the flights at the inner surface 10 of the drum to house an associated movable debarking surface 22 in its retracted position below the level of the top edge 14 of the flights. For example, in FIG. 2, three adjacent flights 12*a*, 12*b* and 12*c* are interrupted by aligned gaps to define a region to house debarking surface 22.

Each movable debarking surface 22 comprises a plate 24 with at least one upstanding, inwardly extending projection 26 to define an edge to debark log. Plate 24 is curved to generally conform to the curved inner surface 10 of drum 4. Preferably, each plate 24 is dimensioned to extend approximately $\frac{1}{8}^{th}$ to $\frac{1}{4}^{th}$ (45 to 90 degrees) about the circumference of the drum 50. In the illustrated embodiment, plate 24 is formed with three projections 26, however, other arrangements are possible. Preferably, the inner surface of each projection 26 is an abrasive edge 28 to increase the rate at which logs coming into contact with the edge are debarked. In the illustrated embodiment, abrasive edge 28 is formed with serrations or in a toothed pattern, but other arrangements are possible.

The projections 26 mounted to movable debarking plate 24 are positioned and dimensioned such that when plate 24 is adjacent the inner surface 10 of drum 4 in its retracted position, the projections are below the level of the top edges 14 of flights 12. Therefore, logs tumbling within the interior of drum 4 falling toward the lower inner perimeter of the drum will tend to contact the top edges 14 of flights 12 which will debark the logs at a lower rate.

Movable debarking plate 24 is displaceable away from the inner surface 10 of drum 4 towards rotation axis 6. In this operating position, abrasive edge 28 of movable debarking plate 24 is located above the level of top edges 14 of flights 12 by a distance 30 as illustrated by dashed lines in FIG. 2. Therefore, any logs tumbling within the interior of drum 4 that are adjacent the lower inner perimeter of the drum will tend to contact the abrasive edges 28 of movable debarking plate 24 which will debark the logs at an increased rate.

Movement of the movable debarking plate 24 between the retracted position and the operating position is preferably performed automatically by an activation system. In the illustrated embodiment, the activation system takes the form of an activation plate 40 at the outer surface 44 of drum 4 connected to the movable debarking plate 24 such that debarking plate 24 moves with the activation plate. This is preferably accomplished by interconnecting activation plate 40 at the outer surface of the drum to movable debarking plate 24 at the inner surface of the drum via a plurality of connecting rods 46 that slidably extend through openings 48 in the drum. Openings 48 are formed through sleeves 50 that act to guide and control movement of rods 46. Activation plate 40 is curved to conform generally to the outer surface 44 of the drum.

In the illustrated embodiment, activation plate 40 assumes a default position displaced away from the outer surface of the drum which moves movable debarking plate 24 to its retracted position below the extent of fixed flights 12. Activation plate 40 is biased to the default position by coil springs 52 fitted about rods 46 that extend between the outer surface of drum 4 and activation plate 40. Other biasing arrangements are possible.

Activation plate 40 is engageable by a rotatable element in the form of a roller 56 or a roller assembly to urge the activation plate toward the outer surface of the drum against the biasing force of springs 52 in order to move movable debarking plate 24 to the operating position. A series of rollers 56 are positioned below the drum between, for example, the 4 o'clock and 8 o'clock positions to be engageable with the activation plate 40 and to force the activation plate upwardly in the direction of arrows 57 against the force of gravity and the force of springs 52. This serves to displace each movable debarking plate 24 upwardly to the operating position whenever the plates are in the vicinity of the lower side of the drum and the rollers 56 are positioned to engage the activation plate 40. Debarking tends to occur as lifted logs tumble to the bottom of the drum due to gravity, and abrasive surface 28 of each movable debarking plate 24 is raised above the top edge 14 of flights 12 to increase the rate of debarking. As drum 4 rotates, each movable debarking plate 24 is normally held in its retracted position by springs 52. As each debarking plate 24 rotates through the lower side of drum 4 between the 3 o'clock to 9 o'clock positions, gravity also moves the debarking plate 24 to the retracted position. Therefore, rollers 56 are necessary to move the force the debarking plates upwardly to the operating position.

It is intended that movable debarking plate 24 can be displaceable with respect to inner surface 10 of drum 4 to assume one of a plurality of operating positions allowing contact between the abrasive surface 28 and the logs. Each operating position results in debarking of the logs at a different rate based on the extent to which abrasive surface 28 protrudes above the top edge 14 of flights 12. The various operating positions of the movable debarking plate 24 are established by moving the rollers 56 of the roller assemblies toward or away from the outer surface 44 of drum 4. As illustrated by arrow 70 of FIG. 2, movement of a roller 56 inwardly will result in movable debarking plate 24 being raised to a greater extent above flights 12 for more aggressive debarking whenever the roller engages the associated activation plate 40. Similarly, movement of roller 56 away from drum surface 10 will cause a reduced debarking rate as the abrasive surface 28 is raised to a lesser extent above flights 12.

Although the present invention has been described in some detail by way of example for purposes of clarity and understanding, it will be apparent that certain changes and modifications may be practised within the scope of the appended claims.

We claim:

1. Apparatus for debarking logs comprising:

a drum rotatable about an axis and having an inner surface and outer surface;

at least one movable debarking surface adjacent the inner surface of the drum to debark logs that come into contact with the movable debarking surface at a first rate;

at least one fixed debarking surface at the inner surface of the drum to debark logs that come into contact with the fixed debarking surface at a second rate;

the at least one movable debarking surface being movable with respect to the inner surface of the drum between an operating position to allow contact between the movable debarking surface and the logs and a retracted position to minimize contact between the movable debarking surface and the logs.

2. Apparatus as claimed in claim 1 in which the at least one fixed debarking surface comprises a fixed projection extending radially inwardly from the inner surface of the drum to a top edge and the at least one movable debarking surface is positionable below the extent of the top edge when in the retracted position.

3. Apparatus as claimed in claim 2 in which the at least one fixed debarking surface comprises a fixed projection extending along the inner surface of the drum parallel to the drum axis, the fixed projection being interrupted by a gap to define a region to house the movable debarking surface when in the retracted position.

4. Apparatus as claimed in claim 3 in which the fixed projection is formed with gaps at spaced intervals to define a plurality of regions, each region housing a movable debarking surface in the retracted position.

5. Apparatus as claimed in claim 1 in which the at least one movable debarking surface comprises a plate with at least one upstanding projection to define an edge to debark logs at the first rate.

6. Apparatus as claimed in claim 5 in which the edge to debark logs at the first rate is a serrated edge.

7. Apparatus as claimed in claim 5 in which the movable debarking plate is curved to generally conform to the curvature of the inner surface of the drum.

8. Apparatus as claimed in claim 5 including an activation system for moving the movable debarking system between the operating and retracted positions.

9. Apparatus as claimed in claim 8 in which the activation system comprises an activation plate at the outer surface of the drum connected to the movable debarking plate such that the debarking plate moves with the activation plate.

10. Apparatus as claimed in claim 9 in which the activation plate assumes a default position displaced away from the outer surface of the drum which moves the movable debarking plate to the retracted position.

11. Apparatus as claimed in claim 10 in which the activation plate is biased by springs to the default position.

12. Apparatus as claimed in claim 11 in which the springs extend between the outer surface of the drum and the activation plate.

13. Apparatus as claimed in claim 9 in which the activation plate at the outer surface of the drum is connected to the movable debarking plate at the inner surface by connecting rods that slidably extend through openings in the drum.

14. Apparatus as claimed in claim 9 in which the activation system includes a rotatable element engageable with the activation plate to urge the activation plate toward the outer surface of the drum in order to move the movable debarking plate to the operating position.

15. Apparatus as claimed in claim 9 in which the activation plate is curved to conform to the outer surface of the drum.

16. Apparatus as claimed in claim 1 in which the at least one movable debarking surface is movable with respect to the inner surface of the drum to assume one of a plurality of operating positions allowing contact between the movable debarking surface and the logs, each operating position resulting in debarking of the logs at a different rate.

17. Apparatus as claimed in claim 16 in which the at least one fixed debarking surface extends inwardly from the inner surface of the drum to a top edge and the at least one movable debarking surface is positioned below the top edge when in the retracted position, and is movable inwardly of the inner surface to protrude to various extents past the top edge of the fixed debarking surface to define the plurality of operating positions.

18. Apparatus as claimed in claim 17 including an activation system for moving the movable debarking surface from the retracted position to one of the plurality of operating positions.

19. Apparatus as claimed in claim 18 in which the activation system comprises an activation plate at the outer surface of the drum connected to the movable debarking plate such that the debarking plate moves with the activation plate.

20. Apparatus as claimed in claim 19 in which the activation plate assumes a default position displaced away from the outer surface of the drum which moves the movable debarking plate to the retracted position.

21. Apparatus for debarking logs comprising:

a drum rotatable about an axis and having an inner surface and outer surface;

at least one movable debarking surface adjacent the inner surface of the drum to debark logs that come into contact with the movable debarking surface at a first rate;

the at least one movable debarking surface being movable with respect to the inner surface of the drum between an operating position to allow contact between the movable debarking surface and the logs and a retracted position to minimize contact between the movable debarking surface and the logs.

22. Apparatus as claimed in claim 21 further comprising at least one fixed debarking surface running generally parallel to the axis of the drum on the inner surface, and operable to debark logs when the at least one movable debarking surface is in the retracted position.

23. Apparatus as claimed in claim 22 comprising at least two fixed debarking surfaces wherein the at least one movable debarking surface is located between at least two fixed debarking surfaces, the at least one movable debarking surface being positionable closer to axis of the drum than the at least two fixed debarking surfaces when the at least one movable debarking surface is in the operating position.

24. Apparatus as claimed in claim 22 in which the at least one fixed debarking surface is formed with a gap in the surface and wherein the at least one movable debarking surface is located within the gap and movable closer to the axis of the drum than the fixed debarking surface when the movable debarking surface is the operating position.

25. Apparatus as claimed in claim 21 including an activation system for moving the movable debarking system between the debarking and retracted positions.

26. Apparatus as claimed in claim 25 in which the activation system comprises an activation plate at the outer surface of the drum connected to the movable debarking plate such that the debarking plate moves with the activation plate.

27. Apparatus as claimed in claim 26 in which the activation plate assumes a default position displaced away from the outer surface of the drum which moves the movable debarking plate to the retracted position.

28. Apparatus as claimed in claim 27 in which the activation plate is biased by springs to the default position.

29. Apparatus as claimed in claim 28 in which the springs extend between the outer surface of the drum and the activation plate.

30. Apparatus as claimed in claim 26 in which the activation plate at the outer surface of the drum is connected to the movable debarking plate at the inner surface by connecting rods that slidably extend through openings in the drum.

31. Apparatus as claimed in claim 26 in which the activation system includes a rotatable element engageable with the activation plate to urge the activation plate toward the outer surface of the drum in order to move the movable debarking plate to the operating position.

32. Apparatus as claimed in claim 26 in which the activation plate is curved to conform to the outer surface of the drum.

* * * * *